United States Patent [19]

Trimble

[11] Patent Number: 4,875,593

[45] Date of Patent: Oct. 24, 1989

[54] HANGING SHOWER CADDY

[76] Inventor: Larry J. Trimble, 1625 S. Main St., St. Martinville, La. 70582

[21] Appl. No.: 161,147

[22] Filed: Feb. 26, 1988

[51] Int. Cl.[4] ..... A47F 5/08

[52] U.S. Cl. ..... 211/95; 211/115; 312/252

[58] Field of Search ..... 211/95, 58, 78, 115, 211/129, 131, 144, 163, 13; 248/131; 108/103; 312/305, 245, 252, 207, 125, 135, 229

[56] References Cited

U.S. PATENT DOCUMENTS

| | | | |
|---|---|---|---|
| 846,359 | 3/1907 | Sparmaker et al. | 211/115 X |
| 1,786,594 | 12/1930 | Betzer | 312/35 |
| 2,788,130 | 4/1957 | White | 211/95 X |
| 2,868,386 | 1/1959 | Seyforth | 211/95 |
| 2,965,429 | 12/1960 | Stanger | 312/252 |
| 3,141,712 | 7/1964 | Holmes et al. | 312/305 X |
| 3,275,159 | 9/1966 | James et al. | 211/78 X |
| 3,869,183 | 3/1975 | Frank, Jr. | 312/248 |
| 4,334,623 | 6/1982 | Geary | 211/131 X |

*Primary Examiner*—Sarah A. Lechok

*Attorney, Agent, or Firm*—Pravel, Gambrell, Hewitt, Kimball & Krieger

[57] ABSTRACT

A rotatable shower caddy which can be securely attached to a shower wall having compartments for the storage of bath products such as shampoo, hair conditioner, soap, shaving cream, razors and the like. The shower caddy is generally cylindrical in shape, constructed of relatively inexpensive, corrosion-resistant, easy to clean materials such as plastic or plexiglass. The caddy is easy to assemble and disassemble for installation, storage and cleaning. In includes top and bottom caps which are connected together by a central, vertical rod and a compartmentalized mid-section which rotates around the central, vertical rod.

7 Claims, 2 Drawing Sheets

HANGING SHOWER CADDY

BACKGROUND OF THE INVENTION

The present invention relates to an improved rotatable shower caddy. The present invention further relates to an improved, generally cylindrical shower caddy which may be securely attached to the shower wall having compartments for the storage of bath products such as shampoo, hair conditioner, soap, shaving cream, and razors.

More particularly, the present invention relates to a storage device for bath products that can be hung within the reach of an adult bather, but out of the reach of small children. Furthermore, the device is designed to be relatively inexpensive, and easy to assemble and affix to a shower wall. The device may be constructed of materials that are corrosion-resistant, easy to clean and colorful, such as plastic, plexiglass and the like.

There are a number of shower "caddies" commercially available for storing bath products in a shower. Some of the shower caddies are designed to be removably attached to the neck of a shower head. These devices often are unstable and fall upon the bather as the bath products are removed from the shelves or the position of the shower head is changed. Another more stable shower caddy is a shelving unit which fits into the corner of a shower and extends from the floor to the ceiling, but these devices are relatively expensive. Typical examples of these commercially available shower caddies appear on page 16 of the Fall 1987, *Hold Everything* catalog.

Various prior art product display and storage units and the like, as well as the apparatus and the method of their construction in general, are known, and found to be exemplary of the following U.S. Pat. Nos.:

| U.S. Pat. No. | Inventor | U.S. Pat. No. | Inventor |
|---|---|---|---|
| 1,213,026 | Sande | 2,965,429 | Stanger |
| 1,732,298 | Arthur | 2,972,420 | Tucci |
| 1,929,677 | Davis | 3,750,818 | Borstcher |
| 2,129,150 | Pekrol | 3,834,782 | Pampinella |
| 2,446,016 | Lessin | 3,850,487 | Batchelor |
| 2,673,781 | Heisler | 4,150,869 | Hansen |
| 2,754,166 | Ohm | 4,353,468 | Klingamon |
| 2,788,130 | White | | |

U.S. Pat. No. 1,213,026 to Sande discloses a storage shelf unit having a circular design, a smaller inner drum and a larger outer drum, each drum having multiple storage compartments. The outer drum is disposed concentrically around the inner drum. The inner drum rotates around a central shaft which is mounted to a base which has antifriction bearings to facilitate the rotation of the shelving units. The upper and lower ends of the central shaft are secured to brackets in the floor and ceiling of a room to hold the storage display unit in place during rotation of the shelves.

U.S. Pat. No. 2,965,429 to Stanger discloses a hanging cabinet having an outer shell and an inner shell which are generally semi-cylindrical. The inner shell is rotatably mounted within the outer shell. Horizontal shelves are positioned within the inner shell to hold household products. Bearings positioned between the base of the inner shell and the base of the outer shell facilitate the relative movement between the shells.

U.S. Pat. No. 2,972,420 to Tucci is a rotatable tool stand having a plurality of radially extending panels which are adapted to support a large number of tools. The radially extending panels rotate around a vertical shaft mounted centrally to a base.

U.S. Pat. No. 3,834,782 to Pampinella discloses a toilet article container which may be attached by a bracket to a shower or bathtub wall. It features a container having sections adapted to store various toilet articles.

U.S. Pat. No. 4,150,869 to Hansen discloses a condensation proof mirror for use in shower stalls and steam baths having utility storage compartments.

These patents or known prior uses teach and disclose various types of display and storage units of sorts and of various manufactures and the like, as well as methods of their construction. But, none of these prior art devices, whether taken singly or in combination, disclose the combination of the present invention for a preferably cylindrical and rotatable shower caddy that can be securely affixed to a shower wall and has a vertical mid-section which rotates around a central axis to provide a relatively inexpensive solution to the problem of storing standard-sized bath product containers within the reach of adult bathers.

GENERAL DISCUSSION OF THE PRESENT INVENTION

The present invention solves the prior art problems and shortcomings in a simple, straightforward manner by providing a shower caddy apparatus which can be secured to a shower wall to store a variety of standard-sized bath products within the reach of adult bathers. The shower caddy generally comprises a top cap, a cylindrical mid-section which rotates around a central, vertical rod, a bottom cap, and means for securing the shower caddy to a shower wall.

In the preferred embodiment of the present invention, the cylindrical mid-section is comprised of opposing upper and lower spaced plates, each opposing plate having an interior and exterior surface. The circumference of each plate is preferably boudned by a retainer ring.

When the shower caddy is assembled, the retainer rings mate with the top and bottom caps and provide a means for maintaining the bath products on the mid-section during rotation. Radially extending vertical partitions span the distance between the opposing plates, dividing the cylindrical mid-section into a plurality of compartments. In the preferred embodiment, at least one horizontal shelf spans the distance between two partitions in order to provide storage space for smaller bath products such as razors. The horizontal shelf and the lower plate of the mid-section have drain holes in order that water may be easily removed from the shower caddy.

The upper and lower plates of the cylindrical mid-section have a central bore through which the central, vertical rod is inserted. The vertical rod has threaded connectors at its upper and lower ends for insertion into threaded bores in the top and bottom caps. Once the rod is secured to the top and bottom caps, its vertical position is maintained through the threaded connections and the mating of the retainer rings of the mid-section with the top and bottom caps.

The top cap has a downwardly extending vertical rim which engages the retainer ring of the upper plate. The retainer ring of the lower plate engages the bottom cap. Both the downwardly extending vertical rim of the top cap and the retainer ring of the lower plate of the mid-section may also have an annular groove which spans their circumference. The retainer ring of the upper plate of the mid-section and the outer surface of the bottom cap may have tongues which surround their circumference. When the shower caddy is assembled, the tongue on the retainer ring of the upper plate engages the annular groove on the interior of the vertical ring of the top cap, and the tongue on the bottom cap engages with the annular groove on the retainer ring of the lower plate. When tongues are thus engaged in the annular grooves, the shower caddy has increased vertical and lateral stability even when the mid-section is rotated. This is particularly beneficial when the weight of the bath products in one compartment or container is disproportionate to the weight of the bath products in the other compartments.

The top and bottom caps have interior surfaces fitted with bearings which are countersunk into races which mate with the exterior surfaces of the upper and lower plates of the mid-section to provide the means for rotating the mid-section around the central rod.

The shower caddy can be secured to the shower wall by a wall flange having an outwardly extending socket which is connected to the top cap which likewise has an outwardly extending socket. A connector pipe has threads at its opposing ends which engage the socket of the top cap and the socket of the wall flange. The wall flange may be affixed to the shower wall by fasteners such as screws, bolts, and the like.

An object of the present invention is to provide a hanging shower caddy which maintains its vertical alignment should bath products of disproportionate weight be stored at various positions thereon.

Another object of the present invention is to provide a hanging shower caddy which is easy to assemble and affix to a shower wall.

Another object of the present invention is to provide a hanging shower caddy which is easy to assemble and disassemble for installation, storage and cleaning.

Another object of the present invention is to provide a hanging shower caddy constructed of materials which are corrosion-resistant, easily cleaned, and colorful, such as plastic or plexiglass.

Another object of the present invention is to provide a hanging shower caddy which has a plurality of separate compartments and shelves of sufficient size to hold standard size containers of bath products.

Another object of the present invention is to provide a hanging shower caddy which is relatively inexpensive.

Another object of the present invention is to provide a hanging shower caddy which is rotatable so that bath products can be stored, viewed and selected by an adult bather, but allows the products to be kept out of the reach of small children.

Yet another object of the present invention is to provide a hanging shower caddy which has compartments with retaining means to hold bath products in place during rotation and selection.

Yet another object of the present invention is to provide a hanging shower caddy with drain holes so that water and soap does not collect in the various compartments.

Yet another object of the present invention is to provide a hanging shower caddy which may be securely mounted onto a shower wall so that neither the apparatus nor the bath products contained thereon fall onto the bather when the bath products are being selected or the device is accidently struck by the bather.

BRIEF DESCRIPTION OF THE DRAWINGS

A better understanding of the invention can be had when the detailed description of the preferred embodiment set forth below is considered in conjunction with the drawings, in which.

DETAILED DESCRIPTION OF THE PREFERRED EMBODIMENT

Figure 1:
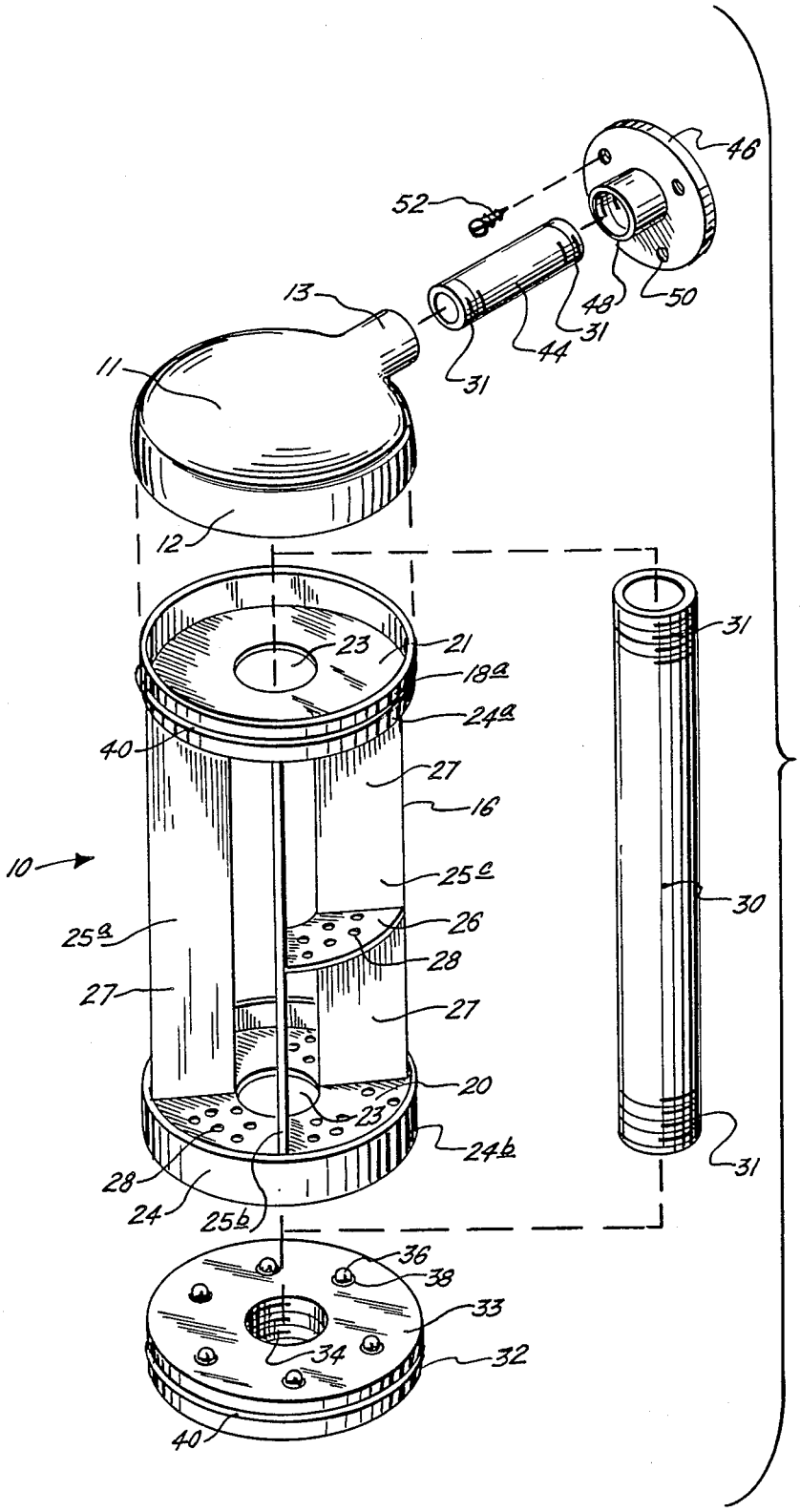
FIG. 1 is a side perspective view of the present invention illustrating a typical construction of the hanging shower caddy apparatus according to a preferred embodiment of the present invention.

Referring now to the drawings, FIG. 1 shows a hanging shower caddy 10 made up of top cap 11, cylindrical rotatable mid-section 16, central rod 30, and bottom cap 32, formed of a corrosion-resistant material for easy assembly and disassembly, which are attached to one another by threaded connectors 31 or other similar securing means.

Top cap 11 has a downwardly extending vertical rim 12 and an integral socket 13.

Cylindrial mid-seciton 16 is composed of opposing upper and lower plates 18(*a,b*) which each have interior surface 20 and exterior surface 21. Each opposing upper and lower plate 18(*a,b*) has center bore 23 for receiving central vertical rod 30.

Opposing upper and lower plates 18(*a,b*) are bound circumferentially by retainer rings 24(*a,b*). Radially extending vertical partitions 25(*a,b,c,d*) are spaced apart from one another and span the distance between opposing upper and lower plates 18(*a,b*). Vertical partition 25(*d*) is not shown.

Horizontal shelf 26 spans the distance between dividers 25(*b,c*). Interior surface 20 of lower plate 18(*b*) forms a floor portion of cylindrical midsection 16. Drain holes 28 in lower plate 18(*b*) and shelf 26 allow water to flow through the hanging shower caddy. Radially extending, vertical partitions 25(*a,b,c*) and horizontal shelf 26 form a plurality of compartments 27 for storing a variety of bath products such as shampoo, hair conditioner, shaving cream and razors which are not shown in the drawings.

Top cap 11 and bottom cap 32 have interior surfaces 33 into which are secured rotating means such as bearings 36 which are countersunk into races 38. Tongue 40 encircles the circumference of retainer ring 24(*a*) and bottom cap 32. Top cap 11 and retainer ring 24(*b*) have interior annular groove 42. When bottom cap 32 is inserted into retainer ringe 24(*b*), tongue 40 engages annular groove 42 which encircles the interior circumference of retainer ring 24(*b*). Once bottom cap 32 is thus engaged, bearings 36 mate with exterior surface 21 of lower plate 18(*b*) to aid the rotation of mid-section 16.

Once tongue 40 of retainer ring 24(*a*) is engaged with annular groove 42 of top cap 11, bearings 36 engage interior surface 21 of upper plate 18(*a*) and also aid the rotation of mid-section 16.

Top cap 11 and bottom cap 32 have center threaded bore 34 for receiving threaded connectors 31 of rod 30.

Figure 2:
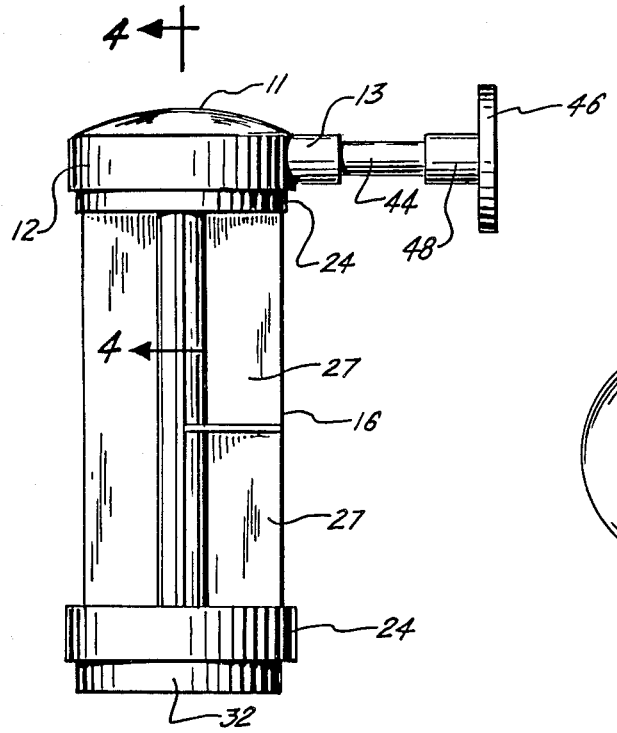
FIG. 2 is a side view of the hanging shower caddy illustrating the components connected together.
Figure 3:
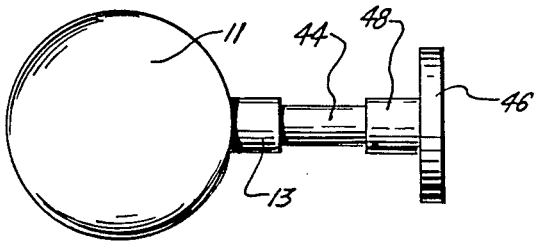
FIG. 3 is a top perspective view of the hanging shower caddy top cap, connector pipe, and mounting flange.
Figure 4:
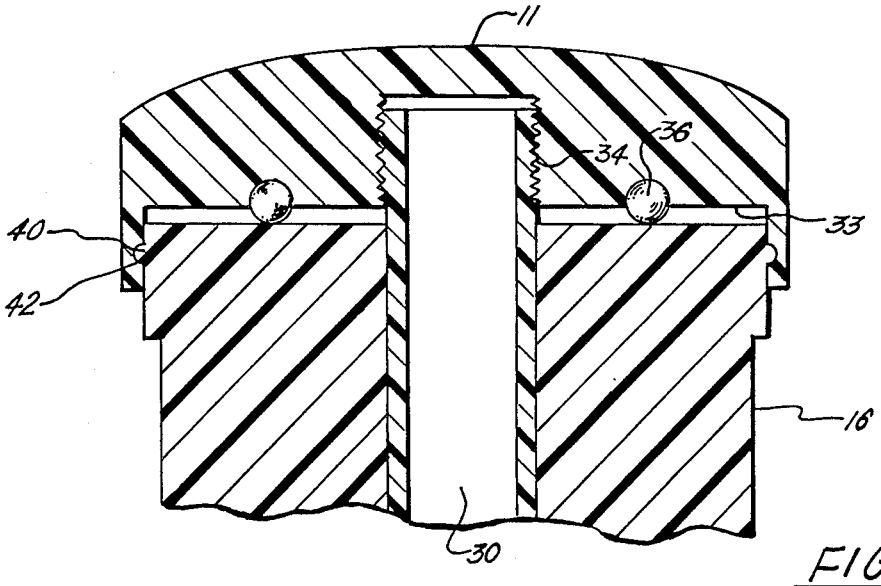
FIG. 4 is a fragmentary sectional view of the top cap and midsection, the plane of the section being indicated by line 4—4 in FIG. 2.

FIGS. 1, 2 and 3 illustrate that hanging shower caddy 10 may be mounted onto a shower wall (not shown) through mounting means such as connector pipe 44 and wall flange 46. Connector pipe 44 has threaded connections 31 on its opposing ends which engage with socket 13 of top cap 11 and integral socket 48 of wall flange 46. Wall flange 46 is connected to the shower wall by fasteners such as screws, bolts or similar means 52. Wall flange 46 has bores 50 to receive securing means 52.

The foregoing description is intended to be illustrative and explanatory of the invention, and various changes in the size, shape and materials, as well as the details of the illustrated construction may be made without departing from the spirit of the invention.

What is claimed as invention is:

1. A side wall mounted shower caddy apparatus for holding bath articles such as soap, razors and the like comprising:

a. a top cap;

b. a mid-section cabinet for holding bath articles;

c. a bottom cap;

d. means connecting to the top cap and defining the sole supporting member for securing the cabinet to a side wall so that bath articles carried by the cabinet do not fall upon the bather;

e. means for rotating the mid-section cabinet with respect to the top and bottom caps so that bath articles may be conveniently selected from the cabinet;

f. means for connecting the top cap, mid-section cabinet and bottom cap together in substantially vertical alignment, wherein there is a central bore in the top cap, mid-section cabinet and bottom cap through which extends a vertical rod which is rigidly secured to the top cap and the bottom cap, and a vertical, downwardly extending rim on the top cap provides an annular groove extending around the circumference of the interior surface of the rim, and the mid-section cabinet includes upper and lower opposing plates bound circumferentially by a pair of retainer rings, including an upper retainer ring having a tongue around an exterior surface for mating with the annular groove of the interior surface of the rim of the cap, the retainer ring of the lower plate having an annular groove extending around the circumference of its interior surface, and the bottom cap having a tongue around its exterior surface for mating with the annular groove of the interior surface of the retainer ring of the lower plate.

2. The shower caddy apparatus of claim 1, wherein the mid-section cabinet is substantially cylindrical and has a plurality of compartments for holding bath articles, said cabinet comprising:

a. a plurality of radially extending, vertical partitions spaced apart from one another and spanning the distance between the upper and lower plates;

b. at least one horizontal shelf which spans the distance between at least two partitions.

3. The shower caddy apparatus of claim 1, wherein the securing means comprises:

a. said top cap having a threaded, outwardly extending socket;

b. a wall flange having a threaded, outwardly extending socket positioned to oppose the socket of the top cap;

c. a connector pipe threaded at its opposing ends for mating with the socket of the top cap and the socket of the wall flange;

d. one or more fasteners such as screws, bolts or the like to attach the wall flange to the shower wall.

4. The shower caddy apparatus of claim 1, wherein the upper and lower plates are spaced apart from one another by a plurality of radially extending partitions, and the top and bottom caps have interior surfaces into which bearings are positioned to mate with the opposing upper and lower plates of the mid-section.

5. The shower caddy apparatus of claim 1, wherein the apparatus is constructed of lightweight corrosion-resistant material such as plastic or plexiglass.

6. The shower caddy apparatus of claim 2, wherein the retainer rings hold the bath products in place while the mid-section is rotating.

7. The shower caddy apparatus of claim 2, wherein the lower plate and the horizontal shelf of the mid-section have drain holes so that water and soap does not collect on the apparatus.

* * * * *